US006123506A

United States Patent [19]

Brand et al.

[11] Patent Number: 6,123,506

[45] Date of Patent: Sep. 26, 2000

[54] DIFFUSER PIPE ASSEMBLY

[75] Inventors: Joseph Horace Brand, Mississauga; Andreas Eleftheriou, Woodbridge, both of Canada

[73] Assignee: Pratt & Whitney Canada Corp., Longueuil, Canada

[21] Appl. No.: 09/233,023

[22] Filed: Jan. 20, 1999

[51] Int. Cl.[7] ..... F04D 29/44

[52] U.S. Cl. ..... 415/208.3; 415/211.2; 415/211.1; 415/224.5

[58] Field of Search ..... 415/208.3, 208.2, 415/211.2, 211.1, 224.5

[56] References Cited

U.S. PATENT DOCUMENTS

| | | | |
|---|---|---|---|
| 2,634,685 | 4/1953 | Buchi . | |
| 3,333,762 | 8/1967 | Vrana | 415/208.3 |
| 4,012,166 | 3/1977 | Kaesser et al. | 415/208.3 |
| 4,854,126 | 8/1989 | Chevis et al. . | |

FOREIGN PATENT DOCUMENTS

| | | | |
|---|---|---|---|
| 967862 | 7/1949 | Germany . | |
| 467943 | 3/1969 | Switzerland . | |
| 673812 | 6/1952 | United Kingdom | 415/208.3 |

*Primary Examiner*—Edward K. Look
*Assistant Examiner*—Richard Woo
*Attorney, Agent, or Firm*—Jeffrey W. Astle

[57] ABSTRACT

The invention provides a diffuser assembly constructed of internal and external concentrically nested bowl-shaped shells for directing an outward flow of compressed air from a centrifugal compressor impeller to an axially rearward diffused annular flow. The shells can be easily manufactured from nested metal castings thereby eliminating much of the cost and time involved in fabricating prior art diffusers of multiple formed tubes brazed to a separately machined hub. The novel diffuser assembly has two concentrically nested bowl-shaped shells, each shell having an inner peripheral compressor impeller casing about a central opening, and an outer edge. Opposing nested surfaces of the shells have an array of mating grooves separated by abutting seam edges thus defining individual diffuser ducts extending from the compressor impeller casings to the outer shell edges when the shells are secured together.

12 Claims, 2 Drawing Sheets

DIFFUSER PIPE ASSEMBLY

TECHNICAL FIELD

The invention is directed to a diffuser for a gas turbine engine that is simply constructed of two concentric nested shells, secured together by brazing for example, each shell having opposing mating grooves which, when the shells are nested together, define an array of diffuser ducts extending from an inner peripheral compressor impeller casing to an annular axially directed outer edge.

BACKGROUND OF THE ART

The compressor section of a gas turbine engine includes a diffuser downstream of the centrifugal compressor turbines and impeller upstream of the combustor. The function of a diffuser is to reduce the velocity of the compressed air and simultaneously increase the static pressure thereby preparing the air for entry into the combustor at a low velocity. High pressure low velocity air presented to the combustor section is essential for proper fuel mixing and efficient combustion.

The present invention is particularly applicable to gas turbine engines which include a centrifugal impeller as the high pressure stage of the compressor. Impellers are used generally in smaller gas turbine engines. A compressor section may include axial or mixed flow compressor stages with the centrifugal impeller as the high pressure section, or alternatively a low pressure impeller and high pressure impeller may be joined in series.

A centrifugal compressor impeller draws air axially from a low diameter. Rotation of the impeller increases the velocity of the air flow as the input air is directed over impeller vanes to flow in a radially outward direction under centrifugal force. In order to redirect the radial flow of air exiting the impeller to an annular axial flow for presentation to the combustor, a diffuser assembly is provided to redirect the air from radial to axial flow and to reduce the velocity and increase static pressure.

A conventional diffuser assembly generally comprises a machined ring which surrounds the periphery of the impeller for capturing the radial flow of air and redirecting it through generally tangential orifices into an array of diffuser tubes. The diffuser tubes are generally brazed or mechanically connected to the ring and have an increasing cross-section rearwardly. As a result, the narrow stream of air at high pressure taken into the orifices in the ring are expanded in volume as the air travels axially through the diffuser tubes. By the well known Bernoulli theorem (which states that total energy of a fluid flow remains constant being the sum of the pressure energy, potential energy and kinetic energy) the increase in volume results in a reduced velocity and corresponding increase in static pressure.

Fabrication of the diffuser tubes is extremely complex since they have a flared internal pathway that curves from a generally radial tangential direction to an axial rearward direction. Each tube must be manufactured to close tolerances individually and then assembled to the machined central ring. Complex tooling and labour intensive manufacturing procedures result in a relatively high cost for preparation of the diffusers.

In operation as well, diffusers often cause problems resulting from the vibration of the individual diffuser tubes. To remedy vibration difficulties, the diffuser tubes may be joined together or may be balanced during maintenance procedures.

From an aerodynamic standpoint the joining of individual diffuser tubes to the machined ring results in surface transitions which detrimentally effect the efficiency of the engine. On the interior of the tube as it joins the orifice in the ring, there is often a step or transition caused by manufacturing tolerances in the assembly and brazing procedures. Since the air in this section flows at extremely high velocity, the disturbance in air flow and increase in drag as the air flows over inaccurately fit transitions can result in very high losses in efficiency.

In general, the design of diffusers is not optimal since their complex structure requires a compromise between the desired aerodynamic properties and the practical limits of manufacturing procedures. For example, the orifices in the impeller surrounding ring are limited in shape to cylindrical bores or conical bores due to the limits of economical drilling procedures. To provide elliptical holes for example, would involve prohibitively high costs in preparation and quality control. The shape of the diffuser pipes themselves is also limited by the practical considerations of forming their complex geometry. In general, the diffuser tubes are made in a conical shape and bent to their helical final shape prior to brazing. Whether or not this conical configuration is optimal for aerodynamic efficiency becomes secondary to the considerations of economical manufacturing.

It is an aim of the invention therefore, to provide a diffuser assembly which significantly reduces the tooling and manufacturing costs associated with prior art diffuser assemblies.

It is a further aim of the invention to provide a diffuser assembly which provides greater flexibility to the designers of gas turbine engines enabling them to optimize the diffuser structure for improved aerodynamic efficiency and vibration behaviour without concern for the manner in which the diffuser will be actually manufactured.

It is a further aim of the invention to provide a diffuser assembly which has shorter development time for new engines and considerably shorter lead time in normal production by minimizing the operations required for production.

It is a further aim of the invention to eliminate the internal transversal steps between the diffuser tubes and separate internal machined ring of the prior art.

It is a further aim of the invention to lower the weight of engines by reducing the number of parts in a diffuser assembly, and using curved or variable diffuser ducts to reduce the gas generator case diameter.

DISCLOSURE OF THE INVENTION

The invention provides a diffuser assembly constructed of internal and external concentrically nested bowl-shaped shells for directing a radially outward flow of compressed air from a centrifugal compressor to an axially rearward diffused annular flow. The shells can be easily manufactured from metal shapes, for example castings, thereby eliminating much of the cost and time involved in fabricating prior art diffusers constructed of multiple bent tubes brazed to a separately machined hub.

The novel diffuser assembly has two concentrically nested bowl-shaped shells, each shell having an inner peripheral compressor impeller casing about a central opening, and an outer edge. Opposing nested surfaces of the shells have an array of mating grooves separated by abutting seam edges thus defining individual diffuser ducts extending from the compressor impeller casings to the outer shell edges when the shells are secured together.

Preferably the seam edges are located on lands extending laterally between adjacent grooves and the lands extend continuously the length of the grooves. This construction reinforces the structure to resist vibration through the diaphragm action of the lands which are preferably brazed together throughout.

Several significant advantages result from this novel diffuser design. The costs of production are reduced since tooling costs and manufacturing complexity are dramatically reduced when only two shell parts are required. Conventional diffusers in contrast require the separate manufacture of several individual diffuser pipes, the machining of a diffuser hub and precise fitting and brazing of the pipes to the hub. Better performance results from elimination of the internal transversal steps which are present in prior art diffusers at the joint between the hub and each of the pipes.

The designer is freed from many of the constraints imposed by conventional diffuser manufacturing techniques. To a large extent, conventional diffuser configurations are dictated by the limitations of fabrication. Many trade-offs between diffuser performance and manufacturing costs compromise the efficiency of prior art diffusers.

The invention however, releases the designer from many of the considerations dictated by prior art manufacturing methods. Using the nested shells of the invention, the shape and cross-section of diffuser ducts become completely independent of the manufacturing method used permitting the diffuser duct shape to be optimised for aerodynamic and structural efficiency.

By adoption of curved or variable diffusion diffuser ducts, the invention can result in lower overall engine weight by reducing the gas generator case diameter. In conventional engines, the diameter of the compressor impeller combined with the outwardly disposed diffuser assembly largely determines the gas generator case diameter. Any reduction in the outward diameter of the diffuser assembly will reduce the gas generator case diameter and lead to a smaller engine of lesser weight and reduced external drag. The invention provides the designer with the freedom the reduce the external diffuser diameter by curving the diffuser ducts inwardly or by using variable cross-sectional profiles for the diffuser ducts.

The thickness of diffuser duct walls can be optimised for improved performance and minimum weight. If needed, reinforcement can be positioned in selected zones of increased thickness or may include external reinforcing ribs to control vibration, accommodate localised stresses or resist wear.

Design changes can be incorporated with considerably shorter lead time and development of new engines can proceed more rapidly. No tooling is needed to produce prototype castings. Solid model data can be used with laser photolithographic metal powder casting techniques to rapidly produce metal prototypes for example.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
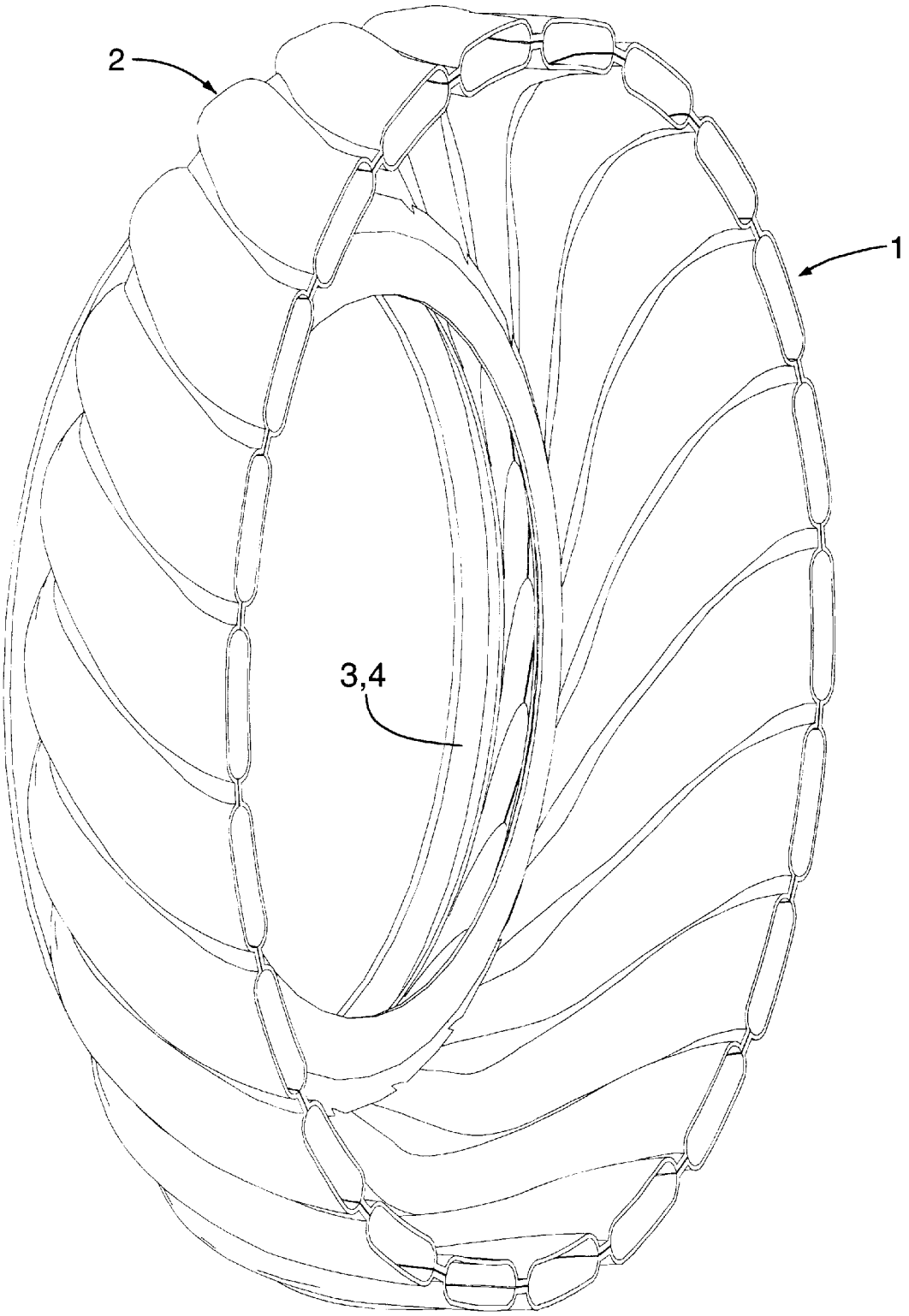
FIG. 1 is a perspective view of a diffuser assembly according to the invention showing two bowl-shaped shells nested together to form an array of diffuser ducts extending from a central compressor impeller casing to axially directed exit nozzles at the outer edge of the diffuser assembly.

FIG. 1 shows a diffuser assembly in accordance with the present invention which directs an outward flow of compressed air from a centrifugal compressor disposed within the internal opening to an axially rearward diffused annular flow.

Figure 2:
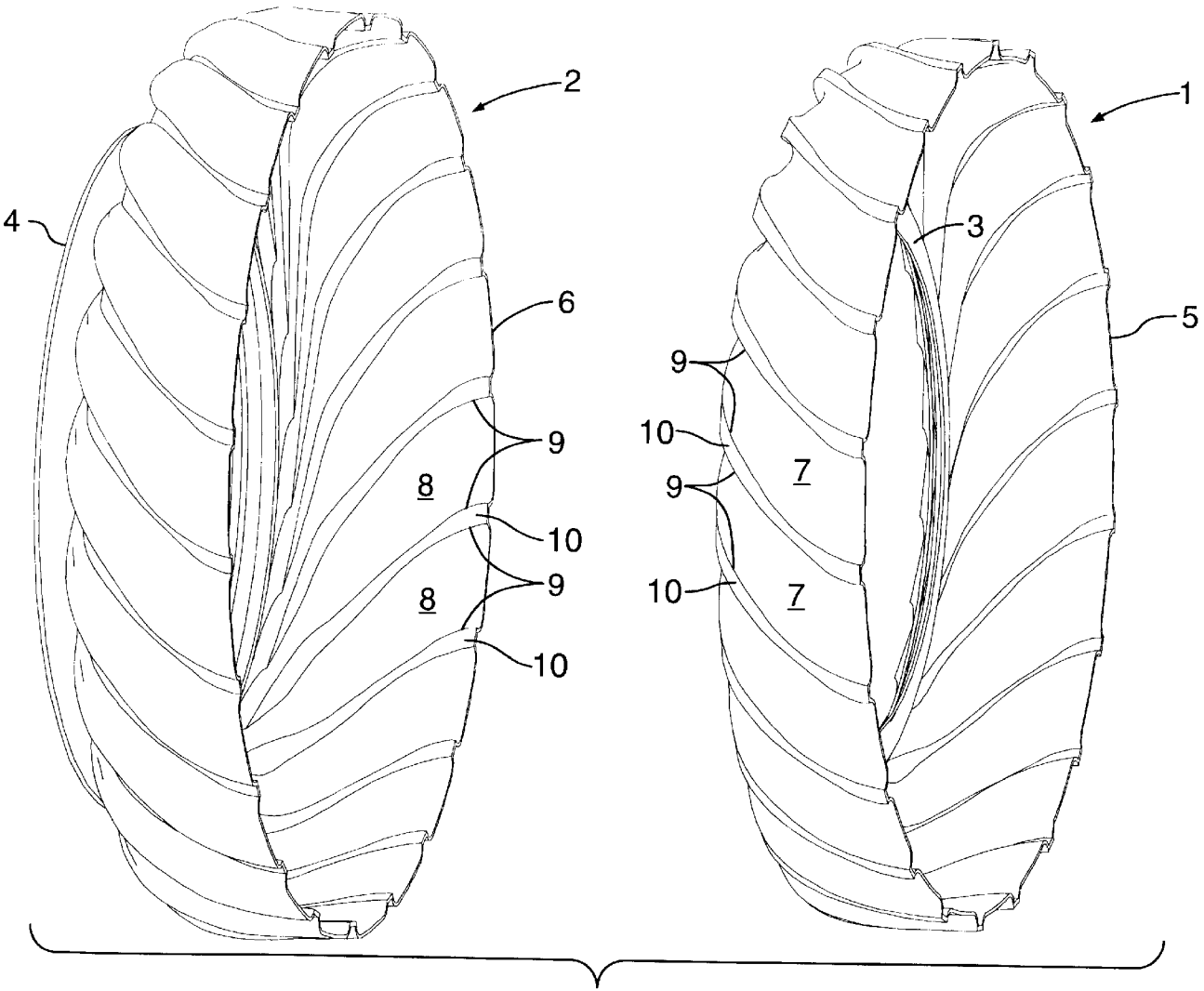
FIG. 2 is an exploded perspective view showing the internal and external concentric shells of the diffuser assembly.

FIG. 2 shows an internal and external concentrically nested bowl-shaped shell identified respectively with reference numerals 1 and 2. Each shell 1 and 2 has an inner peripheral compressor impeller casing 3 and 4 about a relatively large central opening. When the shells 1 and 2 are nested together as shown in FIG. 1, the casings 3 and 4 contain the outward flow of air exiting from the periphery of the impeller, as it rotates at high speed. Each shell 1 and 2 has an outer edge 5 and 6. As best indicated in FIG. 1, the outward air flow contained within the impeller casings 3 and 4, exits through elongate nozzles formed along the outer edges 5 and 6 of the nested shells 1 and 2.

To redirect and diffuse the air flow from a high pressure outwardly directed flow from the impeller casings 3 and 4 to an axially rearwardly directed flow passed the outer edges 5 and 6, each concentrically nested shell 1 and 2 includes an array of mating grooves 7 and 8, which define individual diffuser ducts when the shells 1, 2 are secured together with fastening means (not visible).

In the embodiment shown, the grooves 7 and 8 are separated by abutting seam edges 9 which are disposed on lands 10 extending laterally between adjacent grooves 7 and 8. The lands 10 extend in the embodiment illustrated continuously the length of grooves 7 and 8. The continuous lands 10 join adjacent diffuser ducts together with a continuous diaphragm which can be secured together with fastening means such as brazing, riveting, bolting, spot welding, diffusion welding or fusion welding for example.

It is anticipated by the inventors that the most economical manner of producing these shells 1 or 2 is by metal casting and finish machining the shells 1 and 2. The thickness of the shells 1 and 2 can be substantially uniform throughout, or if desired for vibration control, structural strength or wear resistance, the shells 1, 2 can easily be designed with preselected zones of increased relative thickness.

As shown in FIG. 2 most clearly, the grooves 8 and 7 of each shell 1 and 2 have a cross-sectional area of increasing magnitude from the compressor casing 3 and 4 to the shell outer edges 5 and 6. In the embodiment illustrated, the seam edges 9 are disposed approximately in the center of each diffuser duct and therefore the cross-sectional area of a selected zone in the grooves 7 of the internal shell 1, are substantially equal to the cross-sectional area of the adjacent zone in the grooves 8 of the nested external shell 2. As well, in the illustrated embodiment, the grooves 7 and 8 of each shell 1 and 2 have a substantially constant depth with the width being of increasing magnitude from the compressor casings 3 and 4 to the shell outer edges 5 and 6. The grooves 7 and 8 of each shell 1 and 2, have concave side walls of a selected radius, and as indicated in FIG. 1, the diffuser ducts defined therefore have a semi-circular lateral profile when the shells are nested together.

It will be understood that the shape and orientation of the diffuser ducts shown in the illustrated embodiment are by way of example only. A significant advantage of the invention is to allow the designers to choose any cross-section shape or path orientation for the diffuser ducts which will optimize the efficiency of the diffuser assembly. A commonly used diffuser pipe shape is the one shown in the drawings with a relatively constant width and semi-circular rounded outer edges. However, that the diffuser duct grooves 7 and 8 can as easily be made in an elliptical shape or any other shape desired. Of particular advantage, the transition between the impeller casings 3 and 4 and the grooves 7 and 8 can be made completely smooth without the disadvantageous transition steps found in the prior art. The shape of the grooves 7 and 8 immediately adjacent to the casings 3 and 4 can be elliptical or any optimal shape determined by designers.

As a result therefore, the novel dual shell diffuser assembly provided by the invention significantly reduces the number of parts and tooling required. Better vibration control and prediction results from the structural integrity of the dual shell structure. Lower engine weight is possible by using curved or variable diffusion diffuser ducts to reduce the gas generator case diameter. Designers are free to quickly develop new engines types with non-circular diffuser ducts if desired. Since fewer operations are required in production, there is a considerably shorter lead time required in producing diffuser assemblies. Better aerodynamic performance will result from the elimination of internal transversal steps present in the prior art between separate components of the diffuser assembly.

Although the above description and accompanying drawings relate to a specific preferred embodiment as presently contemplated by the inventors, it will be understood that the invention in its broad aspect includes mechanical and functional equivalents of the elements described and illustrated.

What is claimed is:

1. A diffuser assembly for directing an outward flow of compressed air from a centrifugal compressor impeller to an axially rearward diffused annular flow, the diffuser assembly comprising:

internal and external concentrically nested bowl-shaped shells, each shell having an inner peripheral compressor impeller casing about a central opening, and an outer edge, opposing nested surfaces of the shells having a plurality of mating grooves separated by abutting seam edges thus defining a like plurality of individual diffuser ducts extending from the compressor impeller casings to the outer shell edges when the shells are secured together with fastening means.

2. A diffuser assembly according to claim 1, wherein the seam edges are disposed on lands extending laterally between adjacent grooves.

3. A diffuser assembly according to claim 2, wherein the lands extend continuously the length of the grooves.

4. A diffuser assembly according to claim 3, wherein the shells are of substantially uniform thickness throughout.

5. A diffuser assembly according to claim 3, wherein the shells have preselected zones of increased relative thickness.

6. A diffuser assembly according to claim 1, wherein mating seam edges of each shell are secured together with fastening means selected from the group consisting of: brazed surfaces; rivets; bolts; spot welds; and continuously welded surfaces.

7. A diffuser assembly according to claim 1, wherein the grooves of each shell have a cross-sectional area of increasing magnitude from the compressor impeller casing to the shell outer edges.

8. A diffuser assembly according to claim 7, wherein the cross-sectional area of a selected zone in the grooves of the internal shell is substantially equal to the cross-sectional area of the adjacent zone in the grooves of the nested external shell.

9. A diffuser assembly according to claim 7, wherein the grooves of each shell have a substantially constant depth and a width of increasing magnitude from the compressor impeller casing to the shell outer edges.

10. A diffuser assembly according to claim 9, wherein the grooves of each shell have concave side walls of a selected radius thus defining diffuser ducts with semicircular lateral profile when the shells are nested together.

11. A diffuser assembly according to claim 1, wherein the shells comprise metal castings.

12. A diffuser assembly according to claim 11, wherein the shells have machined surfaces.

* * * * *